United States Patent [19]

Keller

[11] Patent Number: 4,932,322

[45] Date of Patent: Jun. 12, 1990

[54] SWING AWAY COLOR HEAD FOR OFFSET DUPLICATOR

[75] Inventor: James J. Keller, Dallas, Tex.

[73] Assignee: Dahlgren Duplicator Sales, Inc., Marietta, Ga.

[21] Appl. No.: 406,077

[22] Filed: Sep. 12, 1989

Related U.S. Application Data

[63] Continuation of Ser. No. 225,553, July 28, 1988, Patent No. 4,896,599, which is a continuation of Ser. No. 873,771, Jun. 12, 1986, abandoned.

[51] Int. Cl.[5] ..... B41F 5/04

[52] U.S. Cl. ..... 101/219; 101/175; 101/351

[58] Field of Search ..... 101/216, 219, 177, 247, 101/136–137, 139, 140, 143, 144, 184, 185, 217, 218, 248, 348, 349, 351, 212, 351, 205–206

[56] References Cited

U.S. PATENT DOCUMENTS

| | | | |
|---|---|---|---|
| 652,431 | 6/1900 | Goedike . | |
| 1,065,228 | 6/1913 | Elsworth . | |
| 1,164,212 | 12/1915 | Reifsnyder | 101/216 |
| 1,732,846 | 10/1929 | Jones . | |
| 1,867,860 | 7/1932 | Mollet . | |
| 1,911,048 | 5/1933 | Adsit et al. . | |
| 2,046,189 | 6/1936 | Schultz . | |
| 2,118,238 | 5/1938 | Smith . | |
| 2,171,742 | 9/1939 | Dombre . | |
| 3,014,421 | 12/1961 | Townsend | 101/248 |
| 3,323,794 | 6/1967 | Brandt . | |
| 3,347,160 | 10/1967 | Roozee . | |
| 3,521,559 | 7/1970 | Sejeck et al. | 101/137 |
| 3,598,045 | 8/1971 | Miller . | |
| 3,738,265 | 6/1973 | Saueressig | 101/351 |
| 4,011,812 | 3/1977 | Lecha . | |
| 4,111,120 | 9/1978 | Paulson | 101/175 |
| 4,214,528 | 7/1980 | Mirow | 101/175 |
| 4,222,325 | 9/1980 | Edwards . | |
| 4,231,292 | 11/1980 | Stolle | 101/175 |
| 4,290,359 | 9/1981 | Kapoor . | |

FOREIGN PATENT DOCUMENTS

| | | |
|---|---|---|
| 1123267 | 5/1982 | Canada . |
| 29312 | 5/1981 | European Pat. Off. . |
| 142751 | 11/1953 | Sweden . |
| 424710 | 3/1936 | United Kingdom . |

OTHER PUBLICATIONS

Graphics Arts Monthly/Sep. 1984, p. 27, Hamada Advertisement.

Lith-O-Roll, Catalog and Price List, Jan. 1, 1985, p. 58, Schematic View of Ink and Water Rollers for Didde Graphics Tandemer, 17" Offset Printing Unit, Models OP 1713A and OP 1713B.

*Primary Examiner*—Eugene H. Eickholt

*Attorney, Agent, or Firm*—Crutsinger & Booth

[57] ABSTRACT

A second color print head attachment for an offset duplicator including a plate cylinder carrier 20 and an inker carrier 70 arranged to be pivotally secured to a side frame 11 of an offset duplicator press 10. A first pair of register pins 100 and 102 mounted on the inker carrier 70 are received in openings 21 and 23 formed in the plate cylinder carrier 20 for detachably securing inker form rollers 75, 76, and 77 in engagement with the printing plate 35. A pair of rollers 64 and 66 on the plate cylinder carrier 20 extend into guide slots 54 and 56 in a mounting bracket 50 secured to the duplicator press frame 12. The lock-up mounting bracket 50 and the hinge mounting bracket 40 are pivotally secured to the duplicator press frames for rotation by an eccentric actuator 110, 115 for moving the printing plate 35 into engagement with the blanket cylinder 16 in the duplicator press 10. The inker carriage 70 and the plate cylinder carriage 20 can be swung away from the blanket 16 of the duplicator press either separately or in combination.

4 Claims, 4 Drawing Sheets

SWING AWAY COLOR HEAD FOR OFFSET DUPLICATOR

This is a continuation of application Ser. No. 07/225,553, filed 7/28/88, Patent No. 4,896,599 which was a continuation of 06/873,711 filed 06/12/86 now abandoned.

BACKGROUND OF INVENTION

TECHNICAL FIELD

The apparatus described herein is a second printing head for an offset duplicator press in which the inker may be swung away from the printing cylinder to facilitate changing printing plates and the plate cylinder may be swung away from the blanket cylinder to facilitate cleaning the blanket.

BACKGROUND INFORMATION

A two-color offset lithographic printing press having two plate cylinders simultaneously engaging a single blanket cylinder is described in Canadian Patent No. 1,123,267 granted May 11, 1982, to White Consolidated Industries, Inc. The Canadian patent discloses a first set of dampening and inking rollers mounted to engage a first plate cylinder fixed to the main frame of the press and a second set of dampening and inking rollers mounted on a carriage which is movable along a pair of spaced rails such that the carriage is linearly movable along a straight line into engagement with a second cylinder mounted on the main press frame. Similar systems are disclosed in U.S. Pat. No. 4,231,292 which issued Nov. 4, 1980; U.S. Pat. No. 4,222,325 which issued Sept. 16, 1980; and U.S. Pat. No. 4,214,528 which issued July 29, 1980.

A carriage which moves linearly for moving inking and dampening rollers into engagement with a printing plate in two-color offset duplicators of the type described in the aforementioned patents, when moved to an inoperative position still interfere with changing printing plates and cleaning blanket cylinders. When the carriage is moved to disengage the form rollers from the second plate cylinder to print a single color the carriage remains over the delivery station near the second plate cylinder.

Two-color sheet fed lithographic offset duplicator presses are commercially available from several manufacturers and assume a variety of different configurations. "Lith-O-Rol Corporation Catalog and Price List for Rollers and Accessories for Offset Duplicators," dated Jan. 1, 1985, illustrates a variety of arrangements of rollers in inking and dampening systems for duplicator presses.

Offset duplicators are generally employed for printing relatively small numbers of copies. Consequently, printing plates must be changed often and press rollers washed up and cleaned when the color of ink is changed.

Duplicator presses used for printing serially numbered checks, tickets, invoices and a variety of forms are equipped with number heads and perforators for printing the numbers on sheets. Presses manufactured by Shinohara Shoji KK of Naganuma, Shizuoka, Japan are provided with swing-away type numbering and second-color imprinting units as optional attachments on an offset duplicator for printing sheets 20½×14-3/16 inches. The swing-away construction of the numbering and imprinting unit permits movement of the accessory away from the impression cylinder when not in use.

Swing-away numbering heads for simultaneously perforating, imprinting and numbering are also available from Hamada of Brea, Calif.

Offset duplicators heretofore devised have incorporated a large number of rollers in a relatively compact space in an effort to minimize the size of the printing press. Wash-up and make-ready of offset duplicators heretofore devised has been difficult and unduly time consuming because rollers are not readily accessible.

SUMMARY OF INVENTION

A second color print head attachment for a single color offset duplicator press including a plate cylinder carrier and an inker carrier arranged to be pivotally secured to the drive side of an offset lithographic duplicator press. A first pair of register pins mounted on the inker carrier are received in openings formed in the plate cylinder carrier for securing inker form rollers in engagement with the printing plate. A pair of register pins on the plate cylinder carrier extend into guide slots in a mounting bracket secured to the operator side of the duplicator press frame. The lock-up mounting bracket and the hinge mounted bracket are pivotally secured to the duplicator press frames for rotation by an eccentric actuator for moving the printing plate into engagement with the blanket cylinder in the duplicator press. The inker carriage and the plate cylinder carriage can be swung away from the blanket of the duplicator press either separately or in combination to facilitate cleaning cylinders and changing printing plates.

DESCRIPTION OF DRAWING

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
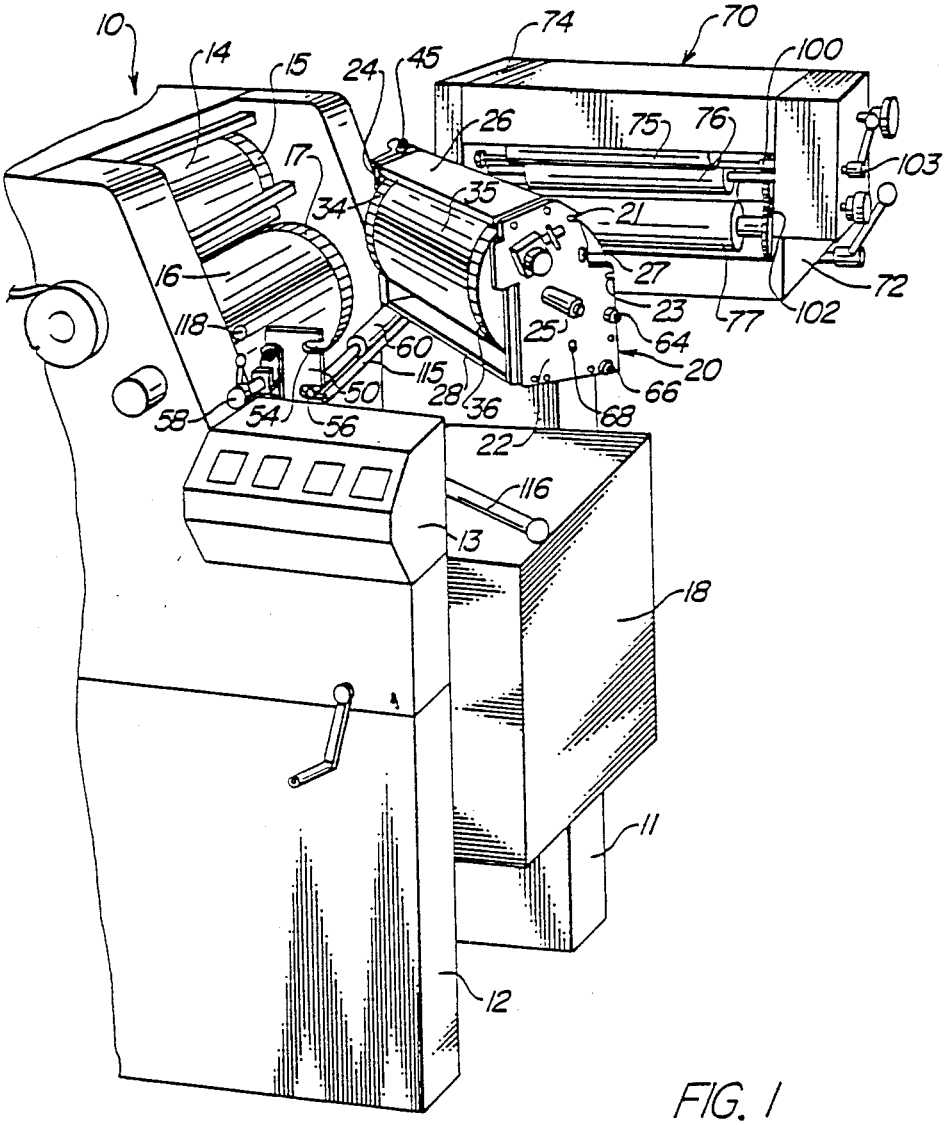
FIG. 1 is a fragmentary perspective view of an offset duplicator press having the improved second color cylinder and inking system pivotally secured thereto.

Referring to FIG. 1 of the drawing, the numeral 20 generally designates a plate cylinder carrier, while the numeral 70 generally designates a carrier for inker and dampening rollers, each being pivotally secured to the drive side side frame 11 of an offset duplicator press generally designated by the numeral 10. Duplicator press 10 is provided with a plate cylinder 14 and blanket cylinder 16 rotatably secured between drive side side frame 11 and operator side side frame 12. Plate cylinder 14 and blanket cylinder 16 are driven by gears 15 and 17 in conventional manner.

Press 10 is equipped with a conventional control console 13 and a conventional sheet feeder (not illustrated) for moving individual sheets from a stack 18 of paper through the printing press.

Duplicator press 10 is of conventional design, for example commercially available as "Toko Offset, 4700 CD" manufactured by Tokyo Aircraft Instrument Co., Ltd. of Tokyo, Japan. The duplicator press 10 is a single-color offset lithographic duplicator press, parts being broken away to more clearly illustrate the new swing-away second color head including the plate cylinder carrier 20 and inker carrier 70 which will be hereinafter more fully described. It should be readily apparent that other duplicator press designs may be substituted for the specific structure illustrated in the drawing which has been described only for purposes of illustration.

Figure 3:
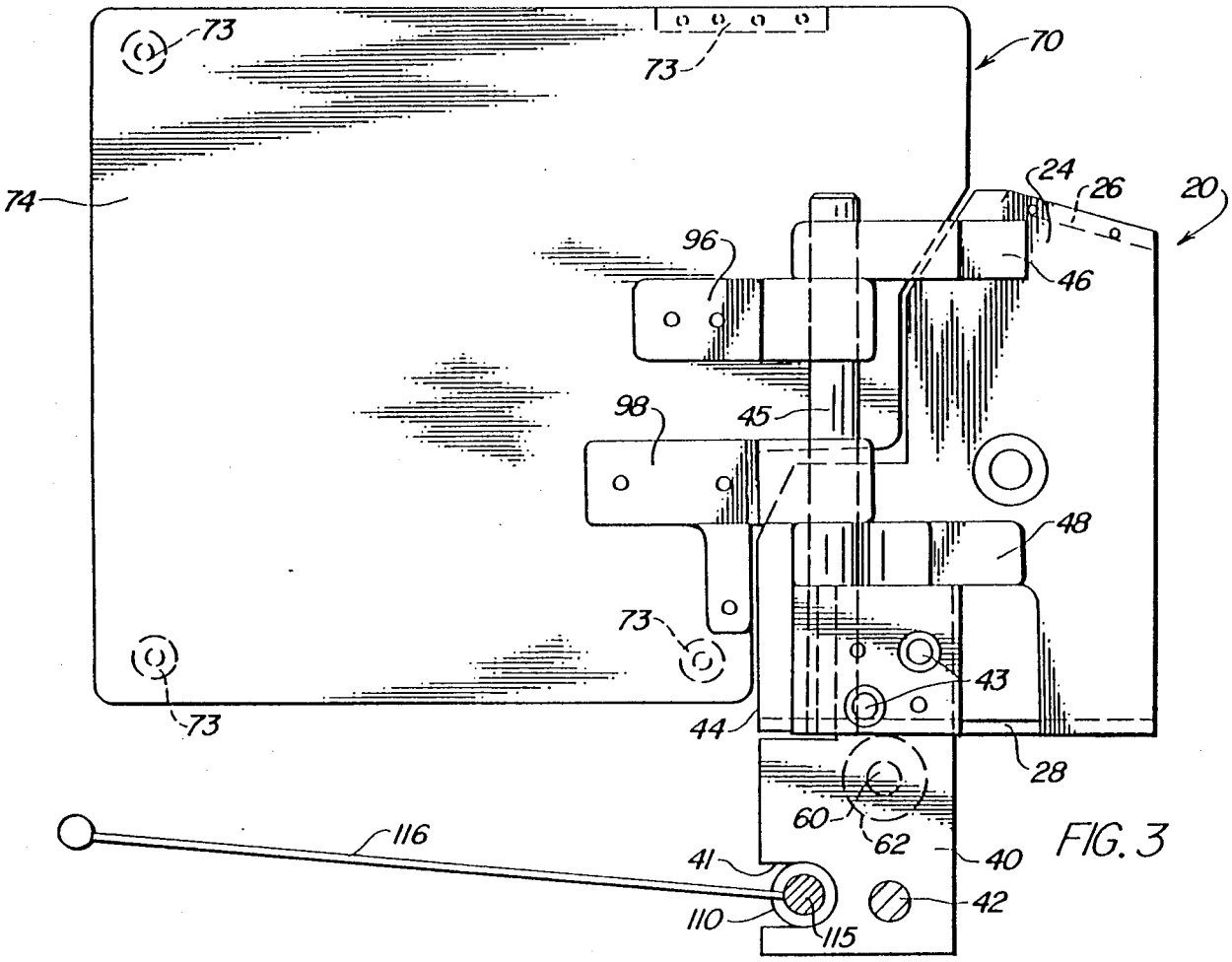
FIG. 3 is a diagrammatic view of the hinge assembly.
Figure 4:
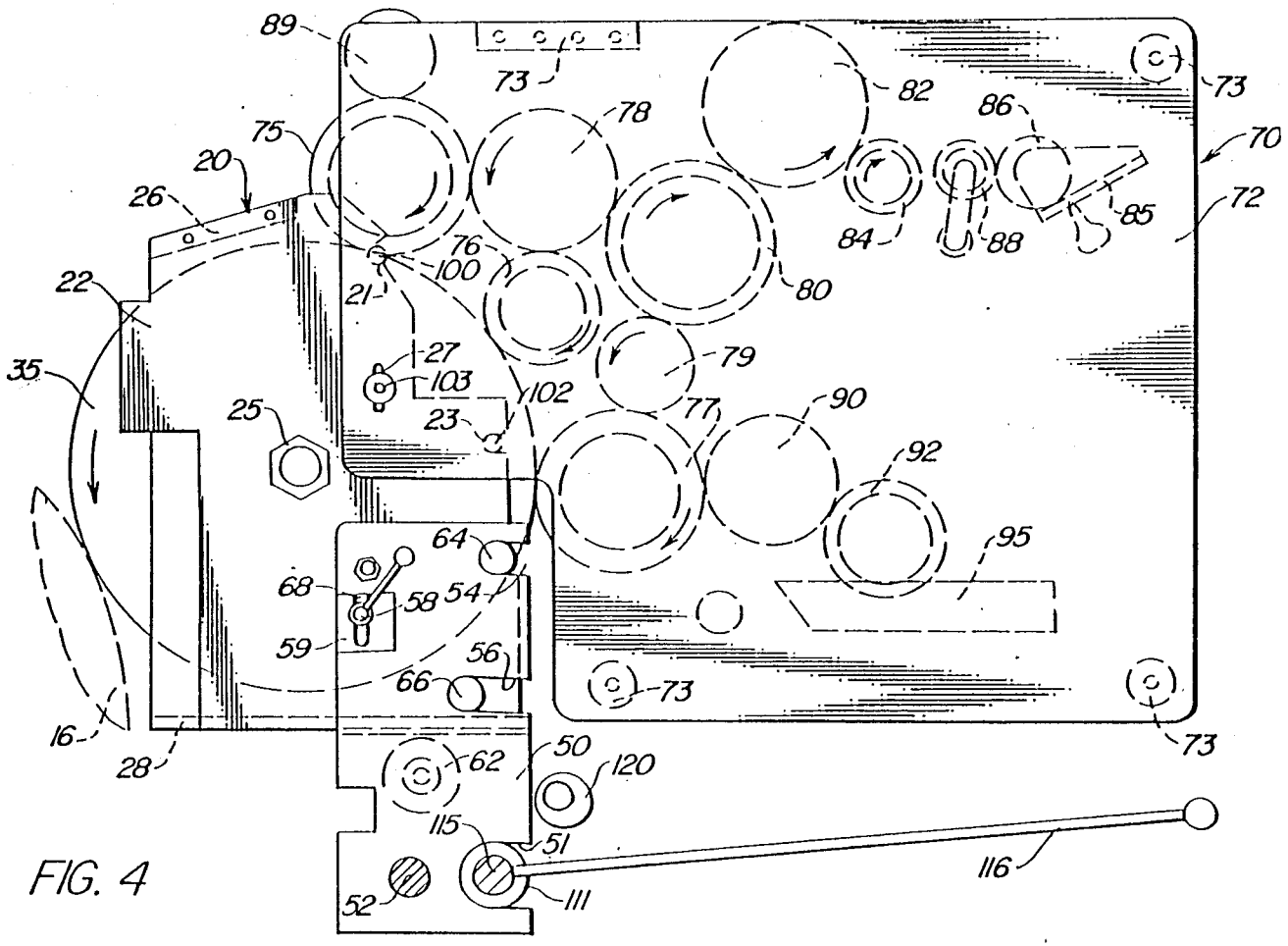
FIG. 4 is a diagrammatic view of a lock-up mechanism for registering rollers of the inking unit, second plate cylinder and blanket cylinder of the printing press.

As best illustrated in FIGS. 3 and 4 of the drawing plate cylinder carrier 20 comprises an operator side side frame 22 and drive side side frame 24 bolted or otherwise secured together by an upper cross member 26 and a lower cross member 28 to form a strong rigid assembly.

A plate cylinder 35 has bearings secured in opposite ends thereof which are rotatably mounted on a shaft extending through openings formed in cylinder side frames 22 and 24. Suitable lateral register adjustment mechanism 25 is positioned between side frame 22 and plate cylinder 35.

As best illustrated in FIG. 1 of the drawing, plate cylinder 35 has gears 34 and 36 mounted on opposite ends thereof. As will be hereinaftermore fully explained, gear 34 connected to plate cylinder 35 is movable into meshing relation with gear 17 on blanket cylinder 16 when printing press 10 is to be operated for applying images from two plate cylinders to blanket 16.

Figure 2:
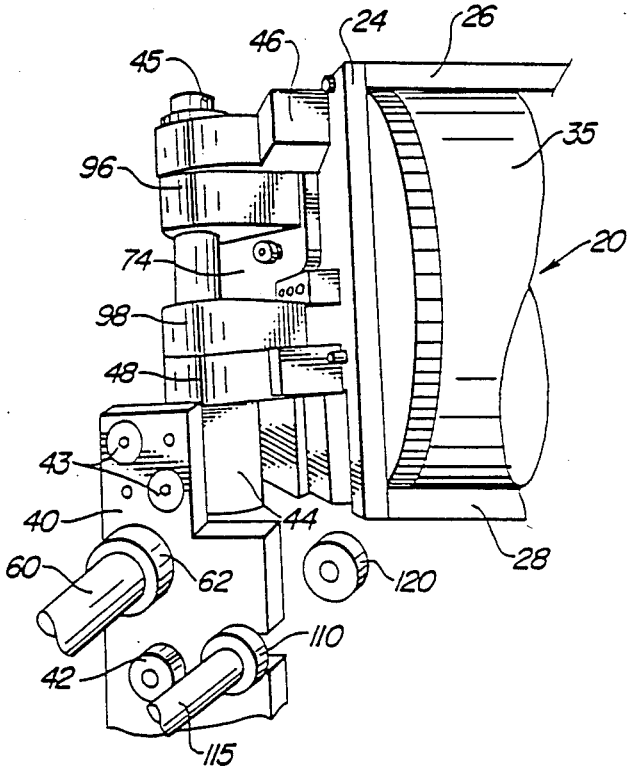
FIG. 2 is a fragmentary perspective view of the hinge mechanism secured to the side frame of the drive side of the press when the plate cylinder and inker are pivoted to an inoperative position.

Referring to FIGS. 2 and 3 of the drawing, a pivot hanger 40 is pivotally secured by a stub shaft 42 to side frame 11 on the drive side of printing press 10. The press side frame has been omitted in FIGS. 2 and 3 of the drawing.

A pivot pin 45 extends into an aperture in bearing block 44 which is secured to pivot hanger 40 by bolts 43. Hinge lugs 46 and 48 are welded or otherwise secured to side frame 24 of plate cylinder carrier 20.

As best illustrated in FIGS. 1 and 4 of the drawing a plate cylinder lock-up hanger 50 is pivotally secured by a stub shaft 52 to side frames 12 on the operator side of duplicator press 10. As will be hereinafter more fully explained, lock-up hanger 50 is provided with a pair of generally horizontally extending slots 54 and 56 and has a latch bolt 58 which is movable through an aperture in lock-up plate 50. Latch bolt 58 is supported by a bracket 59 bolted or otherwise secured to the lock-up hanger 50.

A support bar 60 is secured between hangers 40 and 50 and has rollers 62 spaced along the length thereof which engage the lower surface of cross member 28 extending between side frames 22 and 24 of plate cylinder carrier 20.

As best illustrated in FIGS. 1 and 4 of the drawing, side frame 22 of plate cylinder carrier 20 has rollers 64 and 66 rotatably secured to the outer surface thereof and positioned to be received in slots 54 and 56 in lock-up hanger 50. An elongated aperture 68 is formed in side frame 22 and receives the end of lock bolt 58 when rollers 64 and 66 are properly seated in slots 54 and 56 to establish and maintain a predetermined relationship between plate cylinder 35 and blanket cylinder 16.

As best illustrated in FIGS. 3 and 4 of the drawing inker carrier 70 comprises a pair of spaced side plates 72 and 74 secured together by tie bars 73.

Rollers which are employed in an inking system and dampening system are illustrated in dotted outline in FIG. 4 of the drawing. It will be appreciated that bearings and gears for driving the inker and dampener are not illustrated in an effort to more clearly illustrated pertinent features of the invention.

The inking and dampening system generally comprises three resilient covered form rollers 75, 76 and 77 which engage the surface of a printing plate on plate cylinder 35. Form rollers 75 and 76 are in engagement with a vibrator roller 78 while form roller 77 is engaged by a vibrator roller 79. A resilient covered ink drum 80 is urged into engagement with hard surfaces of vibrator rollers 78 and 79 and engages a hard surfaced vibrator roller 82 which receives ink from a resilient covered roller 84. Ink from ink fountain 85 is metered onto a fountain roller 86 and is transferred by a resilient surfaced ductor roller 88 to roller 84. A vibrating ink storage roller 89 engages form roller 75 and functions as an equilizer or storage roller for redistributing ink on form roller 75 to minimize ghosting.

It should be appreciated that ink from ductor roller 88 is transferred over rollers 84, 82 and 80 to vibrator roller 79 which engages the first inker form roller 77. Thus, the first inker form roller 77 carries a thicker film of ink than do the second and third form rollers 76 and 75. The film remaining on the surface of roller 80 after it has moved away from vibrator roller 79 is split and transferred to vibrator roller 78 which first engages the third inker form roller 75 and subsequently the second form roller 76.

It should be readily apparent that the first form roller carries a thicker film of ink than form rollers 75 and 76 and that the second form roller 76 carries a thinner film of ink than does the third form roller 75. This roller arrangement facilitates applying and distributing an ink film over the surface of the printing plate.

A hydrophilic transfer roller 90 is urged into pressure indented relation with the first inker form roller 77 and transfers dampening fluid thereto which is supplied through the nip between hydrophilic transfer roller 90 and a resilient surfaced metering roller 92 which extends into dampening fluid in a pan 95.

Referring to FIG. 3 of the drawing hinge lugs 96 and 98 are bolted or otherwise secured to side plate 74 of inker carrier 70. Hinge lugs 96 and 98 have apertures formed therein through which pivot post 45 extends.

As best illustrated in FIG. 3 of the drawing, hinge lugs 96 and 98 are positioned between hinge lugs 46 and 48 which are secured to the plate cylinder carrier 20. This hinge arrangement provides improved stability and minimizes vibration of plate cylinder carrier 20 and inker carrier 70 when printing plate 35 is moved to an operative position for transferring an image to blanket cylinder 16.

Referring to FIG. 4 of the drawing, locator pins 100 and 102 extend inwardly from side plate 72 of inker carrier 70 and are received in passages 21 and 23 in side frame 22 of plate cylinder carrier 20 when form rollers 75, 76 and 77 are positioned in engagement with the surface of plate cylinder 35.

A locking bolt 103 is slidably secured to side plate 72 and extends into an elongated aperture 27 in side frame 22. Thus inker carrier assembly 70 is positioned in a predetermined relationship relative to plate cylinder carrier 20.

As illustrated in FIGS. 3 and 4 of the drawing, pivot hanger 40 and lock-up hanger 50 have cam slots 41 and 51 respectively formed in an edge thereof into which cams 110 and 111 extend. Cams 110 and 111 are eccentrically mounted on an actuator shaft 115 which extends transversely across the press through hanger members 40 and 50 and has opposite ends rotatably secured to side frames 11 and 12 of press 10. An actuating lever 116 is secured to actuating shaft 115. It should be readily apparent that upon rotation of actuating shaft 115, cams 110 and 111 will cause pivot hanger 40 and lock-up hanger 50 to rotate thereby moving plate cylinder 35 on plate cylinder carrier 20 into or out of engagement with blanket cylinder 16 depending upon the direction actuator shaft 115 is rotated.

An on-stop 118 is secured to side frames 10 and 11 of the printing press and engage side frames 22 and 24 of plate cylinder carriage 20 when plate cylinder 35 is properly positioned in a predetermined relationship relative to blanket cylinder 16. An eccentric off-stop 120 is secured to side frames 11 and 12 for engaging hangers 40 and 42 for limiting rearward movement of hangers 40 and 50 when printing plate 35 is separated from blanket cylinder 16.

To facilitate clean-up of the printing press or changing plates, latch bolt 103 is retracted from elongated opening 27 in plate cylinder side frame 22 permitting rotation of inker assembly 70 around pivot post 45 for disengaging form rollers 75, 76 and 77 from printing plate 36. This permits movement of inker assembly 70 to the position illustrated in FIG. 1 of the drawing.

When latch bolt 58 is retracted from elongated opening 68 in plate cylinder side frame 22 of plate cylinder carriage 20, plate cylinder 35 and plate cylinder carriage 20 are movable to the position illustrated in FIG. 1 of the drawing.

When plate cylinder carriage 20 and inker carriage 70 are positioned as illustrated in FIG. 1 of the drawing, it should be readily apparent that blanket cylinder 16 is accessible for wash-up. Plate cylinders 14 and 35 are readily accessible for changing printing plates.

If a single color is to be printed, plate cylinder carriage 20 may be locked to inker assembly 70 by positioning guide lugs 100 and 102 in engagement with surfaces 21 and 23 and locking the members together by inserting latch bolt 103 in elongated slot 27. The composite assembly may be rotated such that the second plate cylinder 35 is positioned substantially perpendicular to the first plate cylinder 14 in a "swung-away" position.

What is claimed is:

1. A printing press having a blanket cylinder and a first plate cylinder rotatably secured between a pair of press side frames, the improvement comprising: a second plate cylinder; a movable carrier for said second plate cylinder; means movably securing said movable carrier to one of the press side frames; means rotatably securing said second plate cylinder to said movable carrier; plate cylinder lock-up means to detachably secure said movable carrier to maintain said second plate cylinder in engagement with said blanket cylinder; inker form rollers; an inker carrier; means rotatably mounting said inker form rollers in said inker carrier; means movably securing said inker carrier for pivotal movement about a substantially vertical axis relative to said plate cylinder carrier; and inker lock-up means detachably securing said inker carrier to said movable carrier to maintain said form rollers in engagement with said second plate cylinder, said movable carrier and said inker carrier being movable to provide access to said blanket cylinder, to both sides of said second plate cylinder and to said inker form rollers.

2. A printing press according to claim 1, said inker lock-up means being adapted to maintain said inker form rollers in a predetermined relationship relative to said plate cylinder when said plate cylinder lock-up means is disengaged to permit movement of said inker carrier for pivotal movement about a substantially vertical axis.

3. A printing press having a blanket cylinder rotatably secured between a pair of press side frames, the improvement comprising: a plate cylinder; a plate cylinder carrier; means securing said plate cylinder carrier for movement about a substantially vertical axis relative to a press side frame; inker carrier means about said vertical axis relative to said plate cylinder carrier; inker means supported by said inker carrier; and means to move said plate cylinder carrier from a position wherein said plate cylinder engages the blanket cylinder to a remote position wherein said plate cylinder is separated from said blanket cylinder; and means to move said inker carrier means about said vertical axis relative to said plate cylinder carrier.

4. A duplicating type printing press having a blanket cylinder mounted in a fixed position, and a first plate cylinder rotatably secured between a pair of press side frames, the improvement comprising: a second plate cylinder; a movable carrier for said second plate cylinder; means rotatably securing said second plate cylinder to said movable carrier; means to position the movable carrier and second plate cylinder to the fixed blanket cylinder to a first printing position and to position the carrier and plate cylinder slightly separated from the blanket cylinder to a non-printing second position; inker form rollers; an inker carrier; means rotatably mounting said inker form rollers in said inker carrier; means movably securing said inker carrier for pivotal movement about a substantially vertical axis relative to said plate cylinder carrier; inker lock-up means detachably securing said inker carrier to said movable carrier to maintain said form rollers in engagement with said second plate cylinder; means to move the plate cylinder carrier and plate cylinder from the slightly separated non-printing second position to a remote third position substantially removed from the fixed blanket cylinder; and means to return and lock the plate cylinder carrier and plate cylinder to the non-printing second position; said movable carrier and said inker carrier being operable in said first and said second positions and movable to the third position to provide access to one side of said blanket cylinder, to both sides of said second plate cylinder and to one side of said inker form rollers.

* * * * *